US010851479B2

(12) United States Patent
Tao et al.

(10) Patent No.: US 10,851,479 B2
(45) Date of Patent: Dec. 1, 2020

(54) APPARATUS AND METHOD FOR IMPARTING FALSE TWIST TO A YARN

(71) Applicant: The Hong Kong Polytechnic University, Kowloon (HK)

(72) Inventors: Xiaoming Tao, Kowloon (HK); Rong Yin, Kowloon (HK)

(73) Assignee: THE HONG KONG POLYTECHNIC UNIVERSITY, Kowloon (HK)

( * ) Notice: Subject to any disclaimer, the term of this patent is extended or adjusted under 35 U.S.C. 154(b) by 96 days.

(21) Appl. No.: 15/801,099

(22) Filed: Nov. 1, 2017

(65) Prior Publication Data

US 2019/0127893 A1 May 2, 2019

(51) Int. Cl.

*D02G 1/02* (2006.01)
*D02G 1/08* (2006.01)
*D02G 3/04* (2006.01)

(52) U.S. Cl.

CPC ..... *D02G 1/022* (2013.01); *D02G 1/0293* (2013.01); *D02G 1/08* (2013.01); *D02G 3/042* (2013.01)

(58) Field of Classification Search

CPC . D01H 7/92; D01H 7/926; D01H 1/11; D02G 1/022; D02G 1/0293; D02G 1/08; D02G 3/042

USPC ..... 57/284

See application file for complete search history.

(56) References Cited

U.S. PATENT DOCUMENTS 3,943,693 A * 3/1976 Raschle ..... D02G 1/06 57/332
3,979,894 A * 9/1976 Takai ..... D02G 1/085 57/336
4,387,557 A * 6/1983 Lorenz ..... D02G 1/087 57/339
4,519,202 A * 5/1985 Hausner ..... B65H 61/005 57/264
4,936,087 A * 6/1990 Mori ..... D01H 1/11 57/328
5,664,409 A * 9/1997 Lorenz ..... D02G 1/08 57/264
6,860,095 B2 * 3/2005 Tao ..... D02G 3/281 57/1 R
7,096,655 B2 8/2006 Tao et al.
7,841,161 B2 11/2010 Cheng et al.

(Continued)

FOREIGN PATENT DOCUMENTS

CH 586296 A5 * 3/1977 ..... D02G 1/08

*Primary Examiner* — Shaun R Hurley
*Assistant Examiner* — Patrick J. Lynch
(74) *Attorney, Agent, or Firm* — Venable LLP; Henry J. Daley

(57) ABSTRACT

An apparatus for imparting false twist to a staple yarn comprising a yarn guide for guiding a staple yarn along a path and a false twist device comprising a convex surface for engagement with a staple yarn so as to impart a force to the staple yarn when the staple yarn engages with and traverses the convex surface of the false twist device, and wherein the relative positioning between the yarn guide and the convex surface of the false twist device is adjustable such that, when a staple yarn is engaged with the convex surface of the false twist device and extends between the yarn guide and the false twist device, the amount of contact between the staple yarn and the convex surface of the false twist device can be controlled.

13 Claims, 7 Drawing Sheets

(56) References Cited

U.S. PATENT DOCUMENTS

| | | | | |
|---|---|---|---|---|
| 8,544,252 | B2 | 10/2013 | Tao et al. | |
| 8,549,830 | B1 * | 10/2013 | Tao | D01H 7/92 57/336 |
| 2013/0255217 | A1 * | 10/2013 | Tao | D01H 7/92 57/284 |

* cited by examiner

APPARATUS AND METHOD FOR IMPARTING FALSE TWIST TO A YARN

FIELD OF THE INVENTION

The present invention relates to an apparatus and method for imparting false twist to a yarn.

BACKGROUND OF THE INVENTION

Staple yarns are produced from discrete lengths of raw fibres or 'staples' of a natural material such as wool, flax, or cotton, or man-made materials such as polyester which have been cut into short, discrete lengths of fibre. The staple yarns are formed in a multi-step process which involves 'twisting' the individual fibres together. The resulting staple yarn is used for weaving or knitting of textile goods. Characteristics of the staple yarn such as the tightness of the twist and 'hairiness' of the yarn can have a number of effects on the properties of the resulting textile goods such as the softness, smoothness, and strength of the textile goods.

Spinning is a fundamental method for producing long strands of staple yarn from staple raw fibres of cotton, wool, flax, or other material. Twisting is a vital process that determines the staple yarn structure and performance such as strength (tenacity), elongation, evenness and hairiness. Ring spinning continues to predominate in the yarn manufacturing industry due to its high yarn quality and flexibility in materials and yarn counts. During the yarn production process, twisting increases fibre coherence and imparts strength to a staple yarn. The initially straight fibres are deformed into helices in a staple yarn, resulting in a part of the mechanical energy being stored in the form of residual torque in the yarn. The residual torque of a staple yarn is the most prominent and fundamental factor contributing to spirality, distortion of single jersey knitted fabrics, and surface unevenness of denim fabric after stone-wash finishing.

Without twisting, there is no yarn residual torque. The lower the yarn twist, the higher the productivity and the lower the residual torque. This is because the yarn production speed is the product of the ratio of spindle speed and the inverse of yarn twist. Thus, reducing yarn twist whilst maintaining spindle speed increases yarn productivity. However, lowering yarn twist inversely decreases yarn strength and can even make the yarn completely unworkable. It is a classic paradox in structural mechanics of ring spun yarns. Consequently, setting is typically needed in downstream processing, such as steaming, plying, and even chemically treating to hold the yarn together. These treatments increase energy consumption, cause fibre damage and increase the production of waste gas, wastewater and chemicals. Thus, downstream processing is not environmentally friendly or cost effective.

Recently, new methods for producing yarns have emerged which involve introducing a so-called 'false twist' into the yarn during the spinning process. Referring to FIGS. 1*a* to 1*c*, the concept of false twist in a yarn is represented schematically. As can be seen from FIG. 1*a*, in a spinning process, the rovings are joined together after passing through a front roller toward a false twisting device to form a singles yarn. This joining step gives rise to the creation of a spinning triangle which is a critical area in the spinning process of staple yarns and the area at which the majority of breakages occurs. The dimensions of the spinning triangle in terms of length and width have a direct impact on yarn quality and susceptibility to breakage. For example, the width Wt of the triangle when exiting the front roller relative to the width of the rovings Wr entering the front roller has an impact on fibre loss, hairiness, and yarn structure. The greater the difference between Wr and Wt, the higher the loss of fibre and the greater the hairiness of the yarn. Thus, it is desirable to keep Wr and Wt as close as possible. However, increasing the width of the triangle Wt can increase the tension on the outer fibres and decrease the tension on the more centrally located fibres, thus, increasing the likelihood of breakage.

Advantageously, introducing a false twist into the yarn improves the spinning triangle dimensions and, hence, quality of the yarn. This is because imparting a false twist to the yarns changes the fibre tension of the yarns and the distribution of tension in the spinning triangle. This change in fibre tension and distribution in the spinning triangle combined with the untwisting of the fibres upon moving beyond the false twisting zones alters the arrangement of fibres and the balance of residual torque in the yarn. More specifically, imparting a high twist level to the fibres greatly shortens the height of the spinning triangle, increases the tension in the fibres at the outer edge of the spinning triangle and buckles the fibres in the middle of the triangle, thereby forming a 'split' structure. The extreme tension variation across this split structure increases fibre migration (the movement of fibres between the central and outside layers of the yarn), enhances fibre-to-fibre interaction and gives rise to particular yarn structures, as desired. Thus, the split structure resulting from the false twist gives rise to increased tension variation and low residual torque yarn. Additionally, the high twist decreases the chances of yarn ends further along the spinning triangle. Since the yarn tension is high after the false twist device, this helps to hold the particular yarn structure during the untwisting process and ensures high yarn quality in the low twist spinning process toward the spindle.

In the example of FIGS. 1*a* to 1*c*, the false twisting device comprises a belt which traverses the yarn as the yarn is fed from the front roller to a bobbin via a ring spinning apparatus. Initially, the belt imparts a 'Z' twist to the yarn between the front roller and the belt and a corresponding 'S' twist to the yarn between the belt and the bobbin. This 'Z' twist between the front roller and the belt changes the fibre tension and distribution of tension in the spinning triangle. As the yarn continues to be fed from the first roller to the bobbin via the belt, the twist is undone by movement of the belt such that a portion of the yarn becomes untwisted beyond the belt as depicted in FIG. 1*b* and a 'Z' twist is introduced further along the yarn. Over time, the belt introduces a 'Z' twist to the entire length of yarn, as depicted in FIG. 1*c*, thereby achieving the improved spinning triangle dimensions, yarn tension and tension distribution, and obtaining a yarn with desired structural properties.

Example patents that employ a false twist include U.S. Pat. No. 6,860,095 B2 which discloses a method of producing torque-free single ring yarns. According to this patent, a fibre strain is divided into a plurality of sub-assemblies of fibres. Each sub-assembly of fibres attains an individual twist value during false twisting, and then are twisted together to form the final yarns. The false twisting is controlled such that balancing of the internal torque of the final yarns is achieved.

U.S. Pat. No. 7,096,655 B2 discloses a method and apparatus for producing a singles ring yarn. In this method, a false twist device rotates at a first speed for twisting the fibres. Immediately after the first twisting step, a joint twist of the second twist in the same direction as the first twist and a third twist in a reverse direction is applied to the preliminary yarn for producing a final singles ring yarn. Moreover, the ratio of the first speed to the second speed is controlled for controlling the residual torque in the final singles ring yarn. However, the technology related to such patents for torque-free singles ring yarn are still at the laboratory scale. This is because the cost of investment and maintenance is high and the means of attachment is too complicated for industrial applications.

U.S. Pat. No. 7,841,161 B2 discloses a method of incorporating a linear false twisting device into a ring spinning process to produce a yarn having a low twist multiplier and a soft feel. In this method, one endless belt is used as a twisting element to generate the false twists in the yarn. This method is simple, cost-effective, and suitable for auto-doffing and easy piecing up. However the amount of false twist generated is limited because the maximum wrap angle of the yarn and belt is less than 50° in most ring spinning machines.

U.S. Pat. No. 8,544,252 B2 discloses a method and apparatus for reducing residual torque and neps in singles ring yarns. This method utilizes a false twist device with two false twisting points to yarns between double belts to improve yarn properties and the efficiency of false twist. U.S. Pat. No. 8,549,830 B1 discloses a method and apparatus for imparting false twist to yarn before ring spinning. In this patent, two separate belts are introduced and controlled by two motors, thus the moving speeds of the two belts can be adjusted separately to further improve the yarn properties. However, the yarn piecing-up and auto-doffing process in a two-belt system are difficult and time-consuming and, thus, cannot completely meet the practical requirements of large scale automatic production in the textile industry. Furthermore, end-breakage prevention and automatic levelling need to be further improved for wide adoption in commercial applications.

Therefore, it will be understood that a need exists for an improved apparatus and method for introducing false twist into a yarn that is able to at least maintain the above-mentioned advantageous properties whilst solving the problems encountered by existing false twist devices.

It is an objective of the invention to address this need or, more generally, to provide an improved apparatus and method of imparting false twist to a yarn between the drafting and ring spinning processes.

SUMMARY OF THE INVENTION

In accordance with a first aspect of the present invention, there is provided an apparatus for imparting false twist to a yarn comprising a yarn guide for guiding a yarn along a path and a false twist device comprising a convex surface for engagement with a yarn so as to impart a force to the yarn when the yarn engages with and traverses the convex surface of the false twist device, and wherein the relative positioning between the yarn guide and the convex surface of the false twist device is adjustable such that, when a yarn is engaged with the convex surface of the false twist device and extends between the yarn guide and the false twist device, the amount of contact between the yarn and the convex surface of the false twist device can be controlled.

Advantageously, adjusting the relative positioning between the yarn guide and the convex surface of the false twist device enables the belt wrap angle to be adjusted according to desired yarn properties. For example, the belt wrap angle can be maintained at a substantial constant through appropriate adjustment of the relative positioning between the yarn guide and the convex surface, thereby ensuring a substantially constant false twist in the spinning zone and enabling the resulting yarn properties to be more accurately controlled. Additionally, the relative positioning between the yarn guide and the convex surface can be adjusted such that the yarn is spaced apart from the convex surface. This enables the yarn to be brought into contact and engaged with the convex surface after the convex surface has commenced moving and achieved a stable movement, thereby reducing the likelihood of yarn breakage.

The yarn guide may comprise a convex surface along which a yarn may be guided such that, when a yarn is engaged with the convex surface of the false twist device and extends along the convex surface of the yarn guide and between the yarn guide and the false twist device, the amount of contact between the yarn and convex surface of the yarn guide is controlled by adjustment of the relative positioning between the convex surface of the yarn guide and the convex surface of the false twist device.

The convex surface of the false twist device may be moveable between a first position in which the convex surface is engageable with a yarn, and a second position in which the convex surface is spaced apart from a yarn.

The apparatus may further comprise a controller operable to adjust the position of the convex surface of the false twist device relative to the yarn guide to control the amount of contact between a yarn and the convex surface of the false twist device.

The controller may be configured to adjust the position of the convex surface of the false twist device relative to the yarn guide to maintain, at a substantial constant, the amount of contact between a yarn and the convex surface of the false twist when a yarn is engaged with the convex surface of the false twist device and extends between the yarn guide and the false twist device.

The amount of contact between a yarn and the convex surface of the false twist device may define a wrap angle, and the controller may be configured to maintain the wrap angle between 45° and 145°.

The yarn guide may be arranged, in use, to guide a yarn along a path toward the convex surface of the false twist device such that the yarn engages and traverses the convex surface of the false twist device.

The false twist device may comprise a belt and the belt may comprise the convex surface for engagement with a yarn. The apparatus may further comprise a drive means operable to drive the belt to move at a speed which is substantially proportional to a speed of rotation of a roller of an apparatus for producing yarn. The controller may be configured to drive the belt to move at a speed which is between 0.5 and 2.0 times that of the speed of rotation of the roller.

The apparatus may further comprise a speed sensor to measure a speed of rotation of a roller of an apparatus for producing yarn.

The apparatus may be configured to be incorporated into an apparatus for producing yarn.

In accordance with a second aspect of the present invention, there is provided an apparatus for producing yarns comprising a yarn guide for guiding a yarn along a path, a false twist device comprising a convex surface for engagement with a yarn so as to impart a force to the yarn when the yarn engages with and traverses the convex surface of the false twist device, a first front drafting roller and a second front drafting roller together arranged to deliver a yarn to the yarn guide and false twist device, the first front drafting roller arranged beneath the second front drafting roller, wherein the relative positioning between the yarn guide and the convex surface of the false twist device is adjustable such that, when a staple yarn is engaged with the convex surface of the false twist device and extends between the yarn guide and the false twist device, the amount of contact between the staple yarn and the convex surface of the false twist device can be controlled.

The apparatus may further comprise a speed sensor arranged to measure the speed of rotation of a peripheral part of the first front drafting roller. The apparatus may further comprise a drive means operable to move the convex surface of the false twist device relative to a yarn, and a controller operable to control the drive means to adjust the speed of movement of the convex surface of the false twist device in response to the measured speed of the first front drafting roller. The convex surface of the false twist device may be moveable between a first position in which the convex surface is engageable with a yarn, and a second position in which the convex surface is spaced apart from a yarn.

In accordance with a third aspect of the present invention, there is provided a method of imparting false twist to a yarn comprising the steps of guiding a yarn along a path by a yarn guide, bringing the yarn into contact with a convex surface of a false twist device, moving the convex surface of the false twist device relative to the yarn so as to impart a force to the yarn and produce a false twist in the yarn, and adjusting the position of the convex surface of the false twist device relative to the yarn guide so as to control the amount of contact between the yarn and the convex surface of the false twist device.

The method may further comprise the step of moving the convex surface of the false twist device between a first position in which the convex surface of the false twist device engages the false twist device and a second position in which the false twist device is spaced apart from the yarn.

The method may further comprise the step of measuring the speed of rotation of a drafting roller that feeds a yarn to the yarn guide and convex surface of the false twist device and adjusting the speed of movement of the convex surface of the false twist device according to the measured speed of rotation of the drafting roller.

The method may further comprise the step of adjusting the position of the convex surface of the false twist device relative to the yarn guide to maintain, at a substantial constant, the amount of contact between a yarn and the convex surface of the false twist when a yarn is engaged with the convex surface of the false twist device and extends between the yarn guide and the false twist device.

BRIEF DESCRIPTION OF THE DRAWINGS

Preferred embodiments of the present invention will be explained in further detail below by way of examples and with reference to the accompanying drawings, in which:—

DETAILED DESCRIPTION OF THE PREFERRED EMBODIMENTS

Figure 1C:
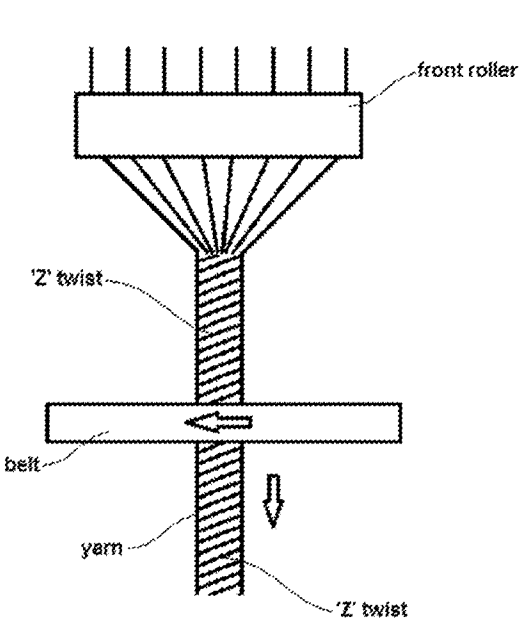
FIG. 1*c* shows how the false twist in the staple yarn of FIG. 1 develops as the staple yarn is moved through the apparatus even further than in FIG. 1*b;*
Figure 1B:
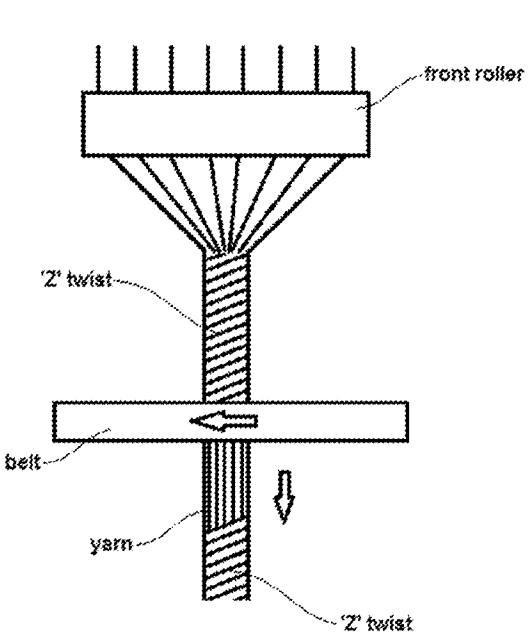
FIG. 1*b* shows how the false twist in the staple yarn of FIG. 1 develops as the staple yarn is moved through the apparatus.
Figure 1A:
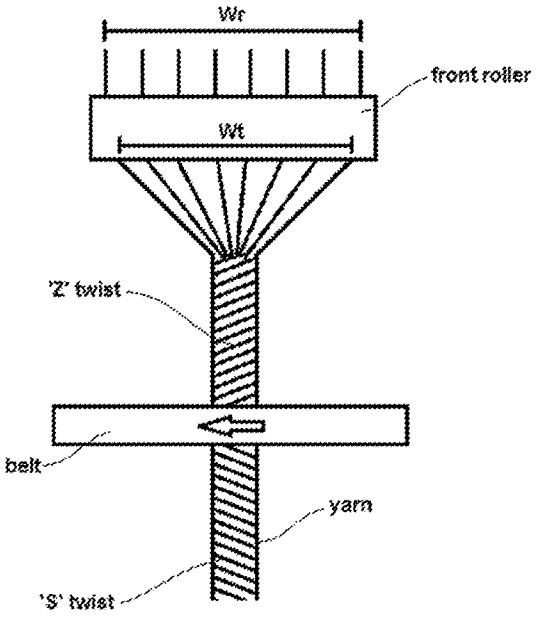
FIG. 1*a* shows a schematic view of a part of an apparatus for producing a staple yarn depicting a false twist in the staple yarn in a first state.
Figure 2:
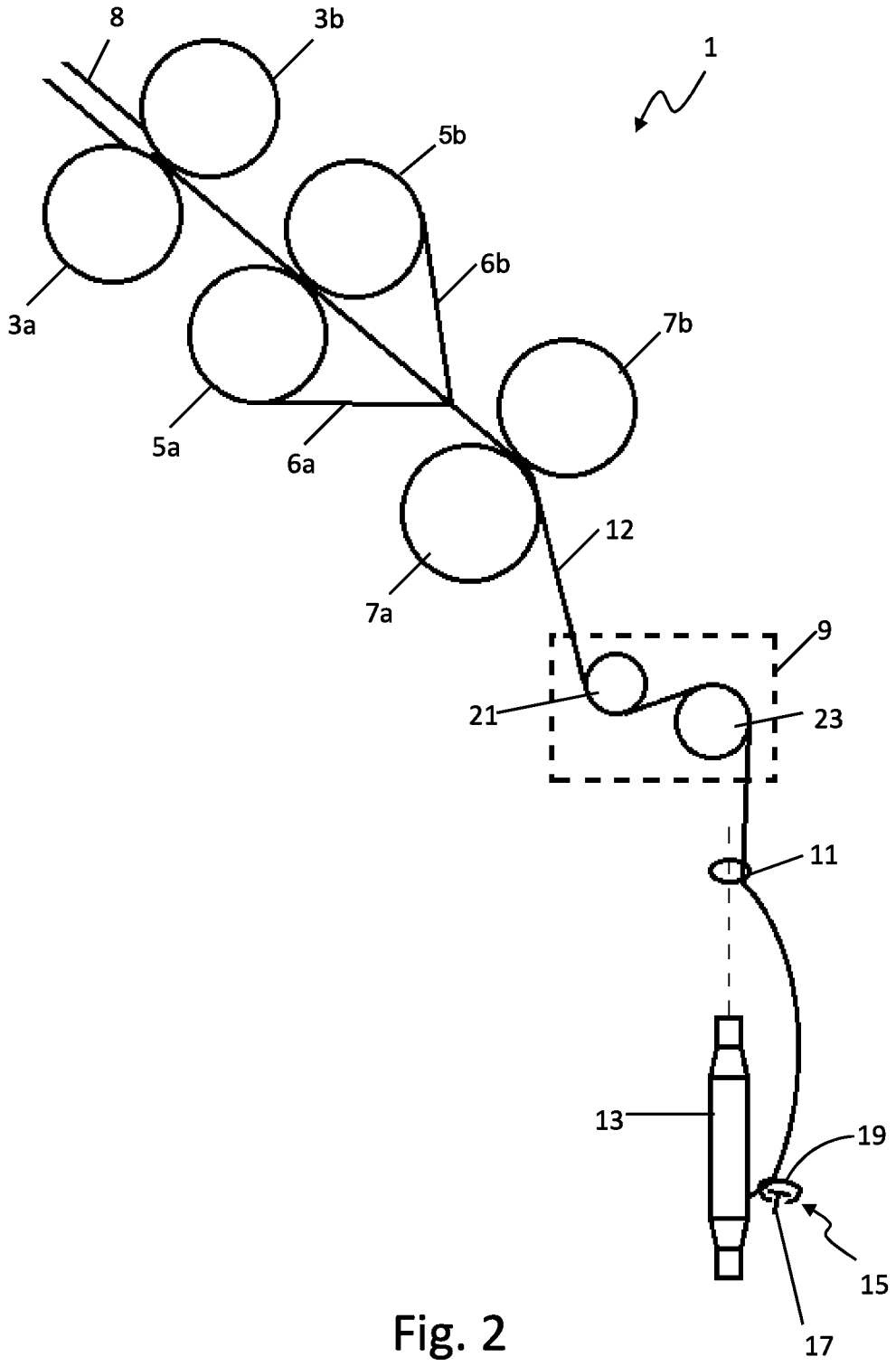
FIG. 2 shows a cross section view of an apparatus for spinning comprising an apparatus for imparting false twist to a yarn according to an embodiment of the present invention.

Referring to FIG. 2, there is shown part of an apparatus 1 for producing singles yarn having low residual torque and hairiness. The apparatus 1 comprises a drafting system comprising three pairs of sequentially arranged bottom and top rollers 3*a*, 3*b*, 5*a*, 5*b*, 7*a*, 7*b*, and a pair of aprons 6*a*, 6*b* associated with the middle pair of rollers 5*a*, 5*b* which form a main drafting zone. The rollers and aprons 3*a*, 3*b*, 5*a*, 5*b*, 6*a*, 6*b*, 7*a*, 7*b* are rotatable by a drive means (not shown) and are together arranged to draw a roving 8 from a roving bobbin (not shown) for further processing by the apparatus 1 into yarn 12. The ring spinning apparatus 1 further comprises a false twist apparatus 9 positioned after the front rollers 7*a*, 7*b* for imparting false twist to a staple yarn 12, a lappet guide 11 for guiding yarn 12 from the drafting system along a path toward a bobbin 13 mounted on a spindle for the receipt of the yarn 12, and a ring and traveller arrangement 15 for directing the yarn 12 onto the bobbin 13 and applying a further twist to the yarn 12.

The lappet guide 11 and bobbin 13 are arranged such that the axis of rotation of the bobbin 13 is substantially aligned with the longitudinal axis of the lappet guide 11. The ring and traveller arrangement 15 comprises a metal ring 17 which is arranged concentrically with, and surrounds, the bobbin 13, and a C-shaped traveller 19 which is engaged with the ring 17 and operable to travel along the ring 17 and, hence, around the bobbin 13. The traveller 19 forms a loop through which the yarn 12 extends to guide the yarn 12 onto the bobbin 13 as the traveller 19 travels along the ring 17.

Figure 3:
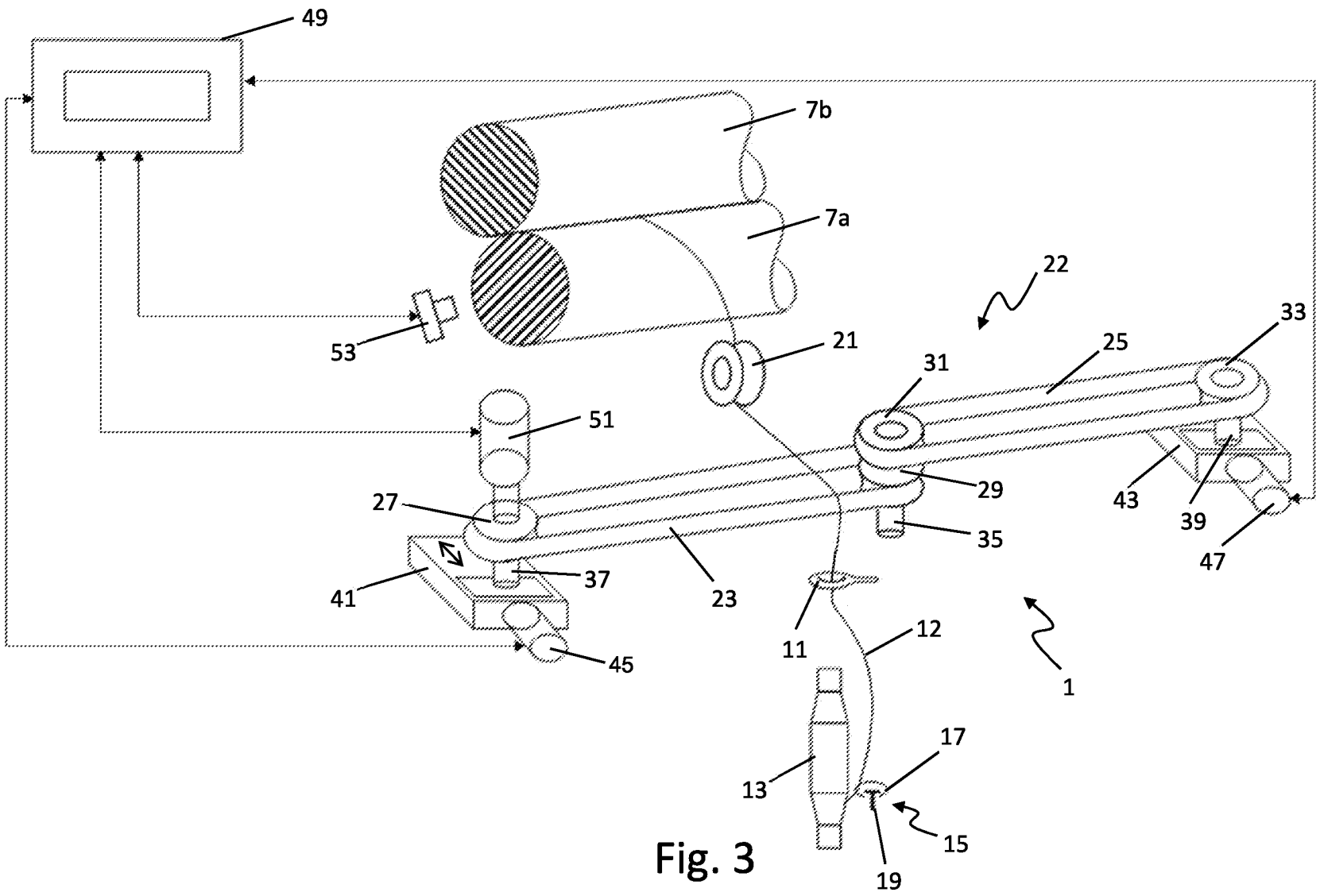
FIG. 3 shows a perspective schematic view of part of an apparatus for industrially producing staple yarns comprising apparatus according to an embodiment of the present invention for imparting a false twist to a short staple yarn.

Referring to FIG. 3, the false twist apparatus 9 comprises a yarn guide 21 and a false twist device 22 operable to impart a force to a yarn 12 to create a false twist in the yarn 12. The yarn guide 21 comprises a pulley which is rotatably supported at a position between the nip of the front rollers 7*a*, 7*b* and the false twist device 22 and arranged to guide a yarn 12 from the front rollers 7*a*, 7*b* to parts of the false twist device 22. The yarn guide 21 comprises a grooved rim which defines a convex surface having a substantially circular cross section about which the yarn 12 may extend and which is configured to limit lateral movement of the yarn 12 so as to confine the yarn 12 to move along a desired path toward the false twist device 22. The grooved rim of the yarn guide 21 is made from or coated with a low friction material such as ceramic so that a twist applied to the yarn 12 may travel along the yarn 12 across the yarn guide 21 and without significant yarn friction or twist blockage due to the yarn guide 21. The yarn guide 21 also comprises an anti-friction bearing for smooth rotation of the yarn guide 21 about its axis to further minimise any affects the yarn guide 21 might have on the false twist imparted to the yarn 12 by the false twist device. Whilst the yarn guide 21 is rotatable in the present embodiment, it is envisaged that a non-rotatable yarn guide 21 may alternatively be used to guide the yarn 12 along a path toward the false twist device, provided the surface of the yarn guide 21 that interfaces with the yarn 12 comprises a low friction material.

The false twist device 22 comprises a first belt 23 and a second belt 25, each having a substantially circular cross section and made from polyurethane material to form a continuous, jointless loop. Each belt 23, 25 is supported and held under tension by a pair of spaced apart pulleys 27, 29 and 31, 33 so as to maintain the two belts 23, 25 in a desired position and shape, and urge the belt to move along the path defined by their respective loops. Each belt pulley 27, 29, 31, 33 comprises a grooved rim that is shaped to receive the corresponding belt 23, 25 so as to restrict lateral movement of the belts 23, 25 and confine the belts 23, 25 to move along the desired pathway. Two of the belt pulleys 29, 31 are coaxially aligned in a stacked arrangement and rotatably supported by a common shaft 35 at a position between the two adjacent outer belt pulleys 27, 33. The common shaft 35 is supported in a substantially upright position by a mechanism (not shown) that is operable to move the position of the shaft 35 relative to the yarn guide 21 along a substantially linear pathway.

The two adjacent outer pulleys 27, 33 are supported by respective shafts 37, 39 and arranged such that their axes of rotation are substantially parallel to the axis of rotation of the middle belt pulleys 29, 31 and also so that the grooved rim of each outer belt pulley 27, 33 is substantially aligned with the grooved rim of the corresponding middle belt pulley 27, 29 of its pair. Thus, each belt 23, 25 is confined to travel within substantially parallel planes by the corresponding belt pulleys 27, 29, 31, 33. Each outer belt pulley 27, 33 is connected to a motorised linear guideway 41, 43 by the corresponding shaft 37, 39.

As with the mechanism supporting the common shaft 35, the linear guideways 41, 43 are configured to move the shaft 37, 39 and, hence, the belt pulleys 27, 33 along a substantially linear track. The linear guideways 41, 43 and mechanism are arranged such that the linear tracks and, hence, linear pathways along which the the belt pulleys 27, 29, 31, 33 travel are substantially parallel. Movement of the shafts 35, 37, 39 is driven by respective stepper motors 45, 47 which are in communication with, and controlled by, a central control system 49. The control system 49 is configured to drive the stepper motors 45, 47 at substantially the same speed so as to move the shafts 35, 37, 39 and belt pulleys 27, 29, 31, 33 at the same speed and in synchronisation. The linear guideways 41, 43 and common shaft mechanism may also be independently controlled by the control system 49 so as to alter the position of the respective belts 23, 25 relative to one or more yarns 12 during operation.

A variable speed rotary motor 51 such as a servo motor, AC motor, or stepper motor is connected to one of the outer belt pulleys 27 and is configured to drive the belt pulley 27 to rotate about the shaft 37. This rotational movement is translated to the attached belt 23 which is driven to move along its pathway and which, in turn, causes the central belt pulleys 29, 31 to rotate and, hence, the second belt 25 to move with its respective belt pulleys 31, 33. The rotary motor 51 is in communication with, and controlled by, the central control system 49 which is configured to drive the belt pulley 27 and, hence, belts 23, 25 to move at varying speeds, as desired.

The false twist apparatus 9 further comprises a speed sensor 53 which is arranged to monitor the speed of rotation of the peripheral part of the bottom front roller 7*a* of the spinning apparatus 1. The speed sensor 53 is communicatively linked to the central control system 49 so as to transmit speed data relating to the bottom front roller 7*a* to the control system 49. The control system 49 is configured to adjust the speed of the rotary motor 51 and, hence, the speed of the belts 23, 25 based upon the measured speed of rotation of the bottom front roller 7*a*. In the embodiment depicted, the control system 49 is configured to adjust the speed of the rotary motor 51 so as to be substantially proportional to the speed of rotation of the bottom front roller 7*a*. Advantageously, it has been found that by synchronising the belt speed with the speed of rotation of the front roller 7*a*, the likelihood of yarn end breakage is reduced. The control system 49 is also configured to maintain the ratio between the speed of the rotary motor 51 and the speed of rotation of the bottom front roller 7*a*. In a preferred embodiment, the control system 49 is configured to maintain the ratio between 0.5 and 2.0 which is the range of ratios within which yarn spinning has been found to be optimized across a range of different material types.

With further reference to FIGS. 2 and 3, it can be seen that the false twist apparatus 9 is incorporated into the yarn spinning apparatus 1 and arranged such that the yarn 12 extends from the front rollers 7*a*, 7*b* along a lower part of the grooved rim of the yarn guide 21, and over the top of the false twist device so that the yarn 12 extends along and is supported by a convex surface of a belt 23. Whilst only a single yarn guide 21 and yarn 12 are depicted, it is envisaged that the false twist apparatus 9 may comprise multiple yarn guides 21 so as to feed multiple yarns 12 to a corresponding multiple of spindles and bobbins 13. Thus, in one embodiment, a belt 23 of the false twist apparatus 9 may be associated with between six and eight spindles/bobbins such that the false twist apparatus 9 correspondingly comprises between six and eight yarn guides 21 to guide the multiple yarns 12 across the belt 23 toward respective bobbins 13 installed on the spindles. Thus, the false twist apparatus 9 may be configured to impart false twist to multiple yarns 12 at the same time. As shown in FIG. 3, the yarn guide 21 is arranged relative to the false twist device such that the yarn 12 is guided by the yarn guide 21 along a path that traverses the belt 23 in a direction which is substantially perpendicular to the direction of movement of the belt 23. As such, any movement of the belt 23 relative to the yarn 12 will impart a false twist to the yarn 12 due to the frictional moment on the moving belt 23.

Figure 4B:
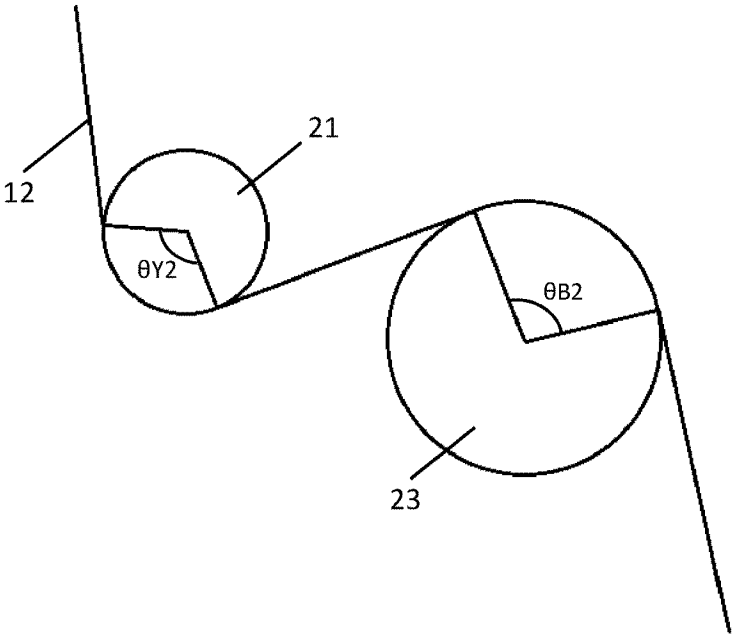
FIG. 4*b* shows the part shown in FIG. 4*b* with different relative spacing between components of the part and a different set of wrap angles.
Figure 4A:
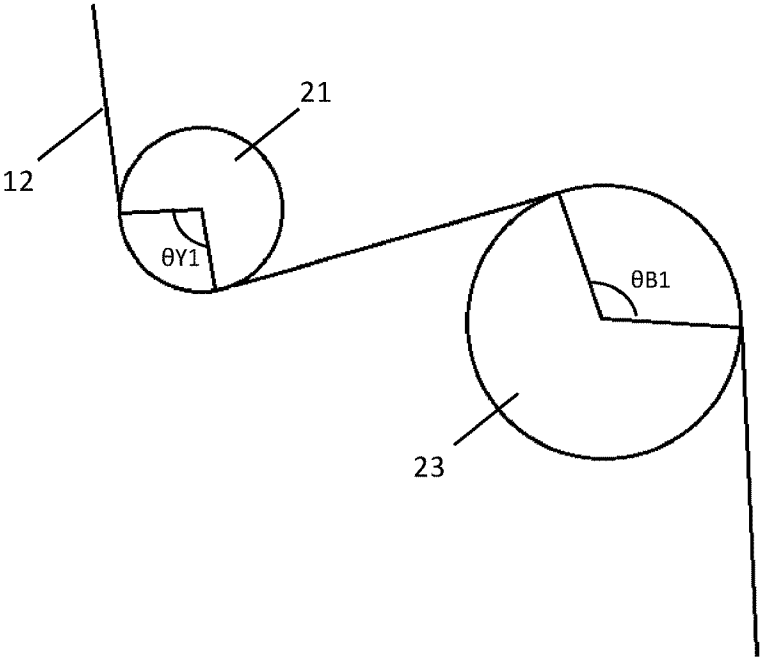
FIG. 4*a* shows part of an apparatus according to the present invention depicting a first set of wrap angles.

Referring to FIGS. 4*a* and 4*b*, it can be seen that the position of a part of the belt 23 can be adjusted relative to the yarn guide 21 by movement of the linear guideways 41, 43. Thus, the position of a convex surface of the belt 23 can be moved toward or away from the yarn guide 21 by the linear guideways 41, 43, as desired. As can be seen, relative movement between the belt 23 and yarn guide 21 changes the amount of contact between the yarn 12 and the yarn guide 21 and belt 23, respectively. The amount of contact between the yarn 12 and the yarn guide 21 and belt 23 defines a yarn guide wrap angle and a belt wrap angle. As shown in FIG. 4*a*, for a given separation between the yarn guide 21 and belt 23, there is a given yarn guide wrap angle $\theta_{Y1}$ and a given belt wrap angle $\theta_{B1}$. When the belt 23 and, hence, convex surface of the belt 23 about which the yarn 12 extends is moved to a position closer to the yarn guide 21, the respective wrap angles are adjusted such that less contact is made between the yarn 12 and the yarn guide 21. Thus, the yarn guide wrap angle is reduced to $\theta_{Y2}$ and the belt wrap angle is reduced to $\theta_{B2}$. Conversely, by increasing the distance of separation between the yarn guide 21 and the belt 23, the yarn guide wrap angle $\theta_Y$ and belt wrap angle $\theta_B$ are increased.

It will be understood therefore that the yarn guide and belt wrap angles can be fine-tuned and adjusted by appropriate relative positioning between the yarn guide 21 and the belt 23 through movement of the shafts 35, 37, 39 by the linear guideways 41, 43 as controlled by the central control system 49. As explained in more detail below, this enables the false twisting efficiency to be improved during operation, which advantageously allows the properties of the yarn 12 to be adjusted during spinning and enables the yarn quality to be maintained. In the embodiment depicted, the false twisting apparatus 9 is preferably configured to adjust the position of the belt 23 relative to the yarn guide 21 so as to produce a belt wrap angle $\theta_B$ falling somewhere between 45° and 145°, as dependent on the desired properties of the resulting yarn 12. This is because it has been found that when the belt wrap angle is below 45° the false twisting is usually too weak to have beneficial effects on yarn properties, and when the belt wrap angle is above 145° a large false twist is imparted into the yarn which causes defects in the resultant yarn.

Figure 5A:
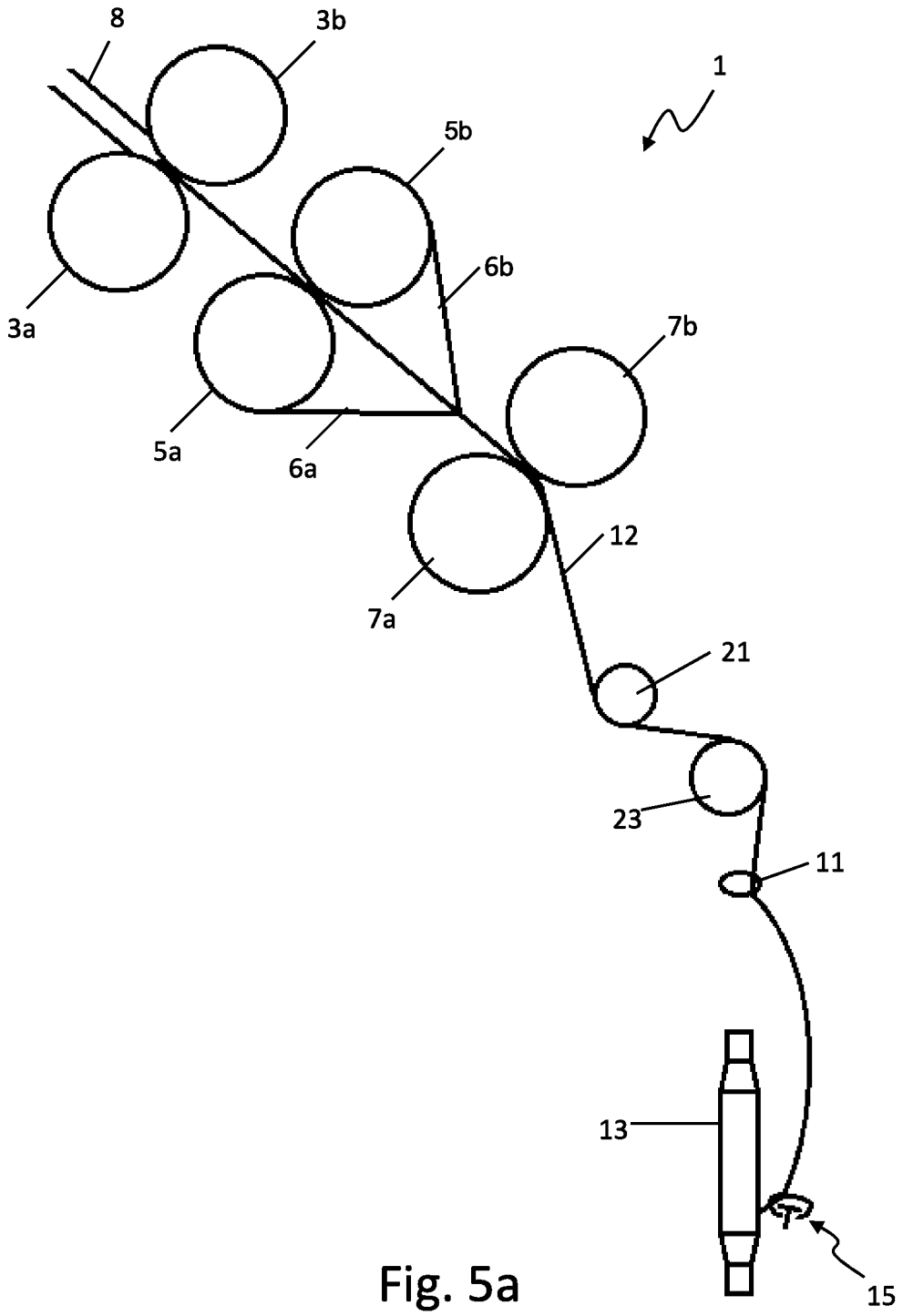
FIG. 5*a* shows part of an apparatus according to the present invention in a first position.
Figure 5B:
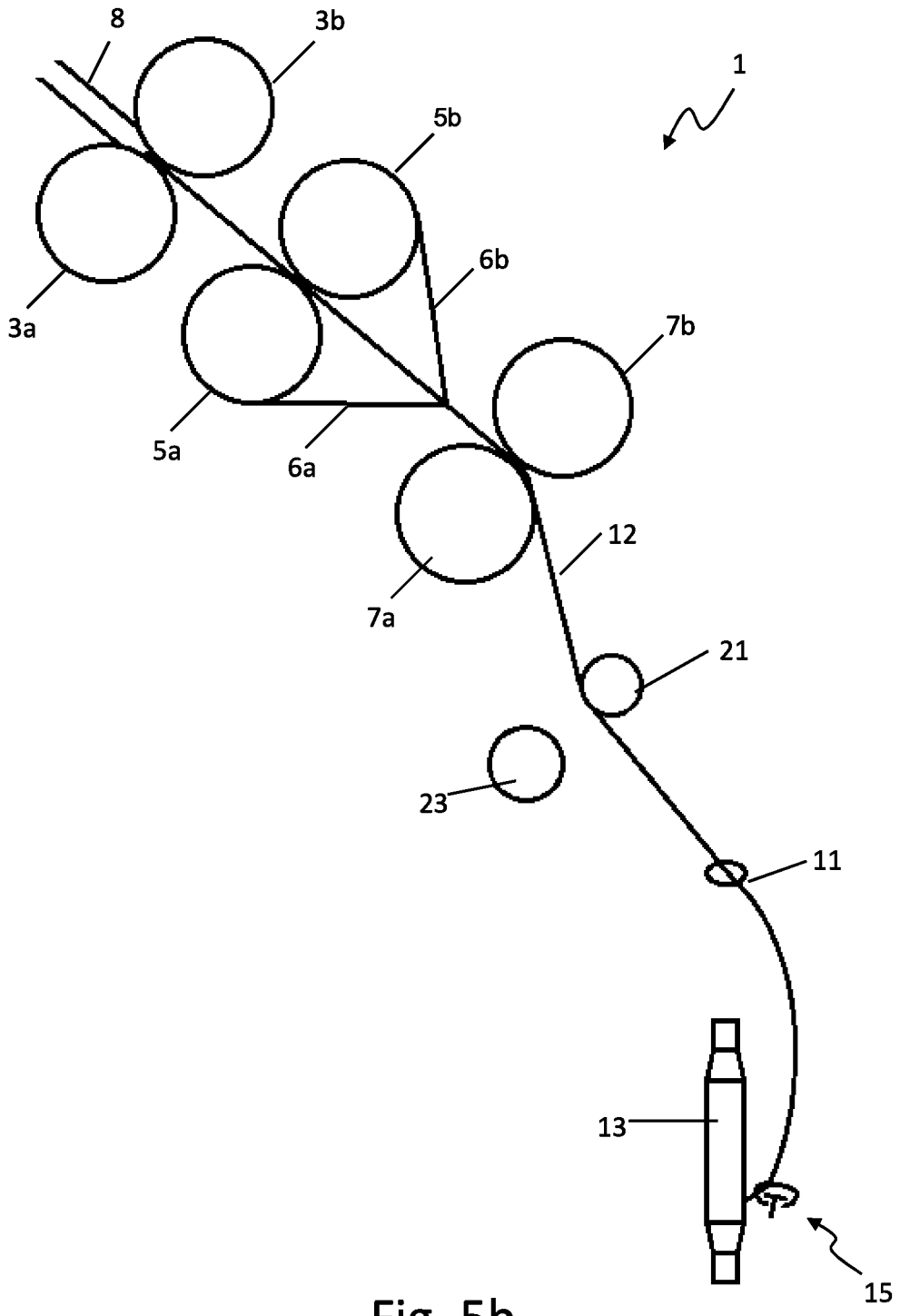
FIG. 5*b* shows the part of the apparatus shown in FIG. 5*a* in a second position.

Referring to FIGS. 5*a* and 5*b*, the linear guideways 41, 43 are also operable by the central control system 49 to move at least one of the belts 23 from a first position shown in FIG. 5*a* in which the belt 23 is in contact with the yarn 12 extending through the apparatus 1, and a second position shown in FIG. 5*b* in which the belt 23 is spaced apart from, and does not contact, the yarn 12. This permits the belt 23 to be brought into contact with the yarn 12 after the belt 23 and yarn 12 have begun moving, or separated from the yarn 12 before the belt 23 or yarn 12 are brought to a stop. Advantageously, it has been found that by first initiating movement of the belt 23 and yarn 12 and then bringing them into contact, the likelihood of breakage of the yarn 12 is reduced. Likewise, by removing the belt 23 from a yarn engaging position before either the belt 23 or yarn 12 are brought to a stop, it has been found that the likelihood of breakage is reduced.

In use, the false twist apparatus 9 is incorporated into a spinning apparatus 1 and a roving 8 is fed into the drafting system for the rollers and aprons 3*a*, 3*b*, 5*a*, 5*b*, 6*a*, 6*b*, 7*a*, 7*b* to process the roving 8 into a fibre bundle. The fibre bundle exits the nip of the front drafting rollers 7*a*, 7*b* and is drawn around the convex surface of the yarn guide 21, through the lappet guide 11 and traveller 17 and onto the bobbin 13. When the yarn 12 is arranged to extend through the apparatus 1 as shown in FIG. 5*b*, the central control system 49 activates the rotary motor 51 of the false twist device to begin movement of the belts 23, 25. The central control system 49 adjusts the speed of the belts 23, 25 according to the measured speed of rotation of the bottom front drafting roller 7*a* and activates the stepper motors 45, 47 to move the belts 23, 25 into the position shown in FIG. 5*a*, thereby bringing the moving belt 23 into contact with the moving yarn 12. In this position, the yarn 12 extends sequentially around the convex surface of the yarn guide 21 and then about a convex surface of the belt 23 before extending toward the bobbin 13 via the lappet guide 11, and ring and traveller arrangement 15.

The moving belt 23 imparts a force to the yarn 12 due to friction between the belt 23 and the yarn 12, thereby creating a false twist in the yarn 12 which becomes trapped between the belt 23 and the front rollers 7*a*, 7*b* and causes a spinning triangle to form at the nip of the front rollers 7*a*, 7*b*. Since the yarn guide 21 comprises a low friction material along which the yarn 12 extends, the false twist is permitted to extend along the yarn 12 toward the nip without significant interference from the yarn guide 21. The yarn 12 then extends from the belt 23 toward the bobbin 13 via the lappet guide 11 and traveller 17 of the ring spinning arrangement 15. The bobbin 13 is driven to rotate by the spindle which rotates the yarn 12 and causes the traveller 17 to travel along the ring 19, thereby forming a spinning balloon between the lappet guide 11 and the traveller 17. The motion of the traveller 17 along the ring 19 produces a further twist in the yarn 12 as the yarn 12 is wound onto the bobbin 13. The apparatus 1 is preferably configured such that the further twist applied to the yarn 12 by the ring spinning arrangement 15 is in the same direction as the false twist applied by the belt 23 to the yarn 12 so as to avoid yarn breakage.

Since the yarn guide 21 is subject to an up and down movement during the ring spinning process due to the action of the traveller 17 moving around the ring 19, the belt wrap angle $\theta_B$ is subject to variations. This variation in wrap angle leads to an uneven distribution of the false twist in the spinning zone between the nip and the yarn guide 21 which gives rise to unstable yarn features or imperfections in the resultant yarns, such as strength deterioration, diameter irregularity and the wrapping of fibres along the length of the yarn. Therefore, the central control system 49 is operable to continually adjust the belt position through control of the linear guideways 41, 43 and, hence, relative spacing between the belts 23, 25 and yarn guide 21 in order to maintain a substantially constant belt wrap angle according to the desired yarn properties.

When a bobbin 13 is full with yarn 12 and must be removed, the apparatus 1 is configured to enter an auto-doffing procedure whereby the position of the moving belts 23, 25 is changed by the central control system 49 from a yarn contacting position (FIG. 5*a*) to a spaced apart, non-contacting position (FIG. 5*b*). As previously described, this process involves activating the stepper motors 45, 47 of the linear guideways 41, 43 and common shaft mechanism to move the shafts 35, 37, 39 and belt pulleys 27, 33 along the respective linear tracks and is preferably undertaken whilst the belts 23, 25 are still moving so as to minimise the risk of yarn breakage. An auto-doffing apparatus may then remove the bobbins 13 from the spindles without interference from the false twist apparatus 9 so that an empty set of bobbins 13 can be arranged on the spindles for the receipt of more yarn 12. When the empty bobbins 13 are loaded onto the spindles and the yarn 12 is attached to the bobbins 13, movement of the yarn 12 through the spinning apparatus 1 is commenced. The control system 49 activates the rotary motor 51 to start movement of the belts 23, 25 and instructs the linear guideways 41, 43 and common shaft mechanism to move the belts 23, 25 back into a yarn engaging position for the application of false twist. Thus, yarn of high quality with tightly controlled properties can advantageously be produced on an industrial scale without significant stops in yarn production.

Figure 6:
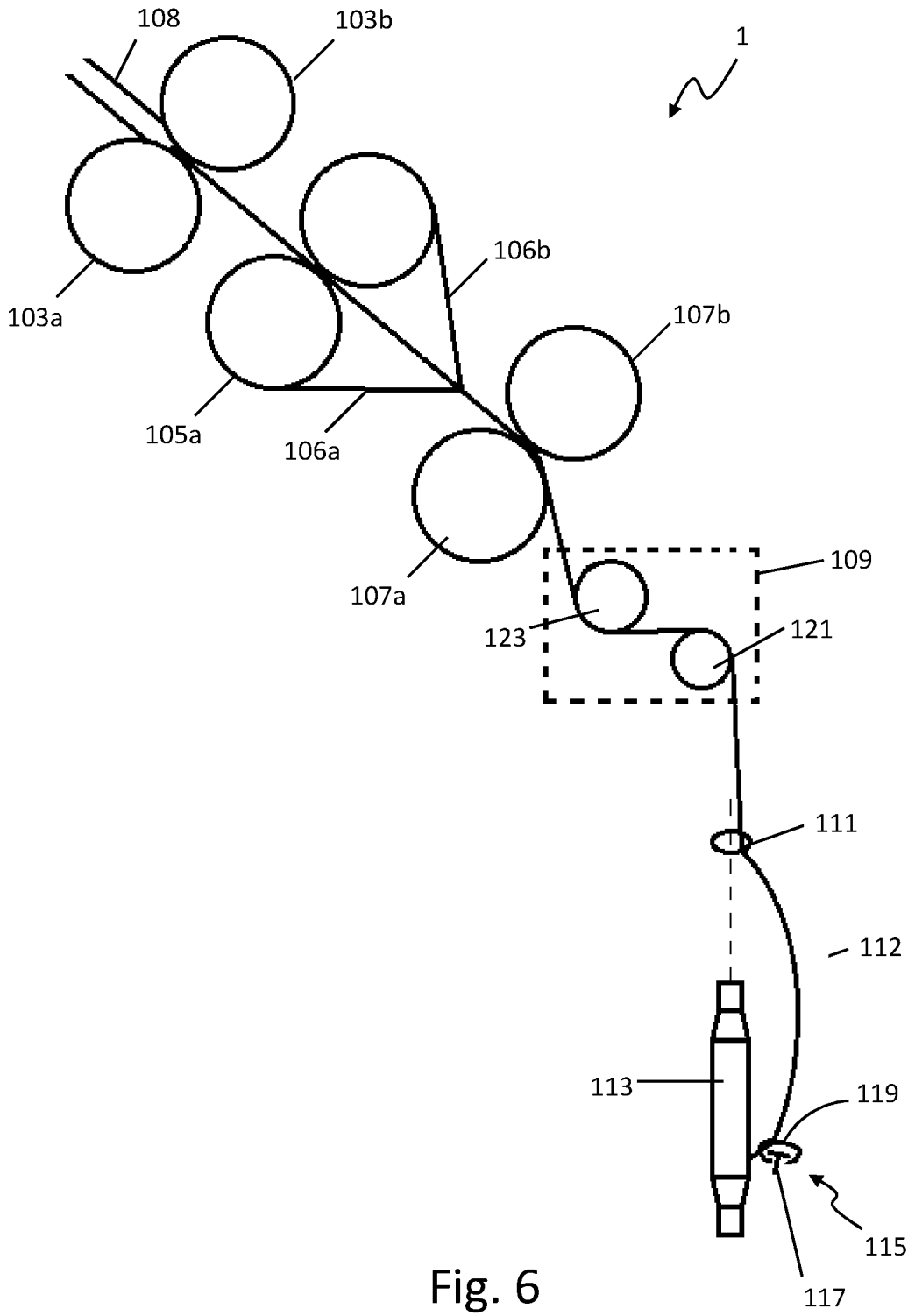
FIG. 6 shows a cross section view of an alternative embodiment of part of an apparatus for ring spinning.

With reference to FIG. 6, in an alternative embodiment, the sequential positions of the belt 123 and the yarn guide 121 are reversed. In all other respects, the false twist apparatus 109 is the same as the above described embodiment and is capable of the same yarn results and enjoys the same advantages and benefits.

The above embodiments are described by way of example only. Many variations are possible without departing from the scope of the invention as defined in the appended claims.

The invention claimed is:

1. An apparatus for imparting false twist to a yarn, comprising:

a yarn guide for guiding yarn along a path; and a false twist device comprising a single convex surface for engagement with a yarn so as to impart a force to the yarn when the yarn engages with and traverses the single convex surface of the false twist device, wherein relative positioning between the yarn guide and the single convex surface of the false twist device is adjustable by a controller of the apparatus such that, when the yarn extends between the yarn guide and the false twist device during operation, the single convex surface of the false twist device is moveable between a first position in which said convex surface is engageable with the yarn, and a second position in which said convex surface is spaced apart from the yarn.

2. The apparatus as claimed in claim 1, wherein the yarn guide comprises a convex surface along which the yarn may be guided such that, when the yarn is engaged with the single convex surface of the false twist device and extends along the convex surface of the yarn guide and between the yarn guide and the false twist device, an amount of contact between the yarn and the convex surface of the yarn guide is controlled by adjustment of relative positioning between the convex surface of the yarn guide and the single convex surface of the false twist device.

3. The apparatus as claimed in claim 1, wherein the controller is configured to adjust positioning of the single convex surface of the false twist device relative to the yarn guide to maintain, at a constant, an amount of contact between the yarn and the single convex surface of the false twist device when the yarn is engaged with the single convex surface of the false twist device and extends between the yarn guide and the false twist device.

4. The apparatus as claimed in claim 3, wherein the amount of contact between the yarn and the single convex surface of the false twist device defines a wrap angle, and wherein the controller is configured to maintain the wrap angle between 45° and 145°.

5. The apparatus as claimed in claim 1, wherein the yarn guide is arranged, in use, to guide the yarn along the path toward the single convex surface of the false twist device such that the yarn engages and traverses the single convex surface of the false twist device.

6. The apparatus as claimed in claim 1, wherein the false twist device comprises a belt and wherein the belt comprises the single convex surface for engagement with the yarn.

7. The apparatus as claimed in claim 6, further comprising a drive means operable to drive the belt to move at a belt speed which is proportional to a roller speed of an apparatus for producing yarn.

8. The apparatus as claimed in claim 7, wherein the belt speed is between 0.5 and 2.0 times that of the roller speed.

9. The apparatus as claimed in claim 1, further comprising a speed sensor to measure a speed of rotation of a roller of an apparatus for producing yarn.

10. The apparatus as claimed in claim 1, configured to be incorporated into an apparatus for producing yarn.

11. An apparatus for producing yarns, comprising:

a yarn guide for guiding yarn along a path;

a false twist device comprising a single convex surface for engagement with yarn so as to impart a force to the yarn when the yarn engages with and traverses the convex surface of the false twist device; and a first front drafting roller and a second front drafting roller together arranged to deliver the yarn to the yarn guide and false twist device, the first front drafting roller arranged beneath the second front drafting roller, wherein relative positioning between the yarn guide and the convex surface of the false twist device is adjustable by a controller of the apparatus such that, when the yarn extends between the yarn guide and the false twist device during operation, the single convex surface of the false twist device is moveable between a first position in which said convex surface is engageable with the yarn, and a second position in which said convex surface is spaced apart from the yarn.

12. The apparatus as claimed in claim 11, further comprising a speed sensor arranged to measure speed of rotation of a peripheral part of the first front drafting roller.

13. The apparatus as claimed in claim 12, further comprising a drive means operable to move the single convex surface of the false twist device relative to the yarn, and a controller operable to control the drive means to adjust a speed of movement of the single convex surface of the false twist device in response to the measured speed of the first front drafting roller.

* * * * *